US008382314B2

(12) United States Patent
Ou et al.

(10) Patent No.: US 8,382,314 B2
(45) Date of Patent: Feb. 26, 2013

(54) LED CHANNEL

(76) Inventors: Fred Ou, Walnut, CA (US); Ying Hsuan Chen, Walnut, CA (US)

( * ) Notice: Subject to any disclaimer, the term of this patent is extended or adjusted under 35 U.S.C. 154(b) by 409 days.

(21) Appl. No.: 12/778,381

(22) Filed: May 12, 2010

(65) Prior Publication Data

US 2011/0280010 A1 Nov. 17, 2011

(51) Int. Cl.
*F21V 5/00* (2006.01)

(52) U.S. Cl. ..... 362/217.02; 362/222; 362/311.02; 362/240

(58) Field of Classification Search ..... 362/217.01, 362/217.02, 222–225, 311.02, 311.06, 331, 362/249.02–249.06, 237, 240
See application file for complete search history.

(56) References Cited

U.S. PATENT DOCUMENTS

| | | | | |
|---|---|---|---|---|
| 7,159,997 | B2 * | 1/2007 | Reo et al. | 362/240 |
| 7,192,161 | B1 * | 3/2007 | Cleaver et al. | 362/260 |
| 7,267,461 | B2 * | 9/2007 | Kan et al. | 362/373 |
| 7,303,310 | B2 * | 12/2007 | You et al. | 362/240 |
| 7,815,338 | B2 * | 10/2010 | Siemiet et al. | 362/218 |
| 8,235,545 | B2 * | 8/2012 | Zheng et al. | 362/218 |
| 2007/0064409 | A1 * | 3/2007 | Hulse | 362/84 |
| 2009/0296381 | A1 * | 12/2009 | Dubord | 362/218 |
| 2010/0103657 | A1 * | 4/2010 | Teng et al. | 362/223 |
| 2010/0177514 | A1 * | 7/2010 | Liu et al. | 362/235 |

* cited by examiner

*Primary Examiner* — Bao Q Truong
(74) *Attorney, Agent, or Firm* — Clement Cheng

(57) ABSTRACT

An LED lamp includes an extrusion which is an elongate extrusion housing. It has an outside lens and a circuit board of elongated shape and mounted to an inside bottom portion of the elongate extrusion housing. A plurality of light emitting diodes can be mounted to the circuit board. A concave lens is mounted to an upper portion of the elongate extrusion housing. The outside lens covers the concave lens forming an outside air gap between the outside lens and the concave lens and a power wire connects to the circuit board. A base end cap receives a wire harness. The wire harness includes power, and the base end cap retains a base end of the outside lens and a base end of the extrusion. A top end cap retaining an end of the extrusion also retains an end of the outside lens.

19 Claims, 3 Drawing Sheets

LED CHANNEL

FIELD OF THE INVENTION

The present invention is in the field of LED lighting.

BACKGROUND

LED channel lighting is useful for a variety of applications such as signage and commercial lighting. LED lighting has become very popular recently. For example, in U.S. Pat. No. 6,660,935 to Southard issued Dec. 9, 2003, the disclosure of which is incorporated herein by reference, an LED light engine has an electrical conductor and a flexible electrically insulating cover surrounding the electrical conductor and an LED mounted to the insulating cover. In Duarte U.S. Pat. No. 5,559,681, issued Sep. 24, 1996, the disclosure of which is incorporated herein by reference, a variety of flexible adhesive lighting sticks are electrically coupled together to provide a variety of different designs. In Cunnien U.S. Pat. No. 7,425,081 issued Sep. 16, 2008, the disclosure of which is incorporated herein by reference, the lamp assembly has multiple LED elements attached to a nonconductive housing by beads of conductive epoxy and the beads of epoxy are disposed in grooves formed on the housing for electrically connecting the LED elements. A large number of patents and a great deal of patent literature is available for review in designing LED lighting.

SUMMARY OF THE INVENTION

An LED lamp includes an extrusion which is an elongate extrusion housing. It has an outside lens and a circuit board of elongated shape and mounted to an inside bottom portion of the elongate extrusion housing. A plurality of light emitting diodes can be mounted to the circuit board. A concave lens is mounted to an upper portion of the elongate extrusion housing. The outside lens covers the concave lens forming an outside air gap between the outside lens and the concave lens and a power wire connects to the circuit board. A base end cap receives a wire harness. The wire harness includes power, and the base end cap retains a base end of the outside lens and a base end of the extrusion. A top end cap retaining an end of the extrusion also retains an end of the outside lens. The extrusion forms a generally circular cross-section with the outside lens. The extrusion is made of extruded aluminum. The outside lens has a pair of protrusions that are inwardly disposed for engaging with a pair of outside lens grooves. The circuit board is made in different parts, and each part has a plurality of LED. The concave lens fits in a pair of concave lens grooves disposed at an upper part of the extrusion. The concave lens reduces the angle of light passing through the outside lens. An intermediate lens is formed as a thin film for adhering to an inside surface of outside lens, or for adhering to an outside surface of concave lens, and the intermediate lens is mounted intermediate the outside lens and the concave lens. A plurality of longitudinal grooves are disposed in an exterior surface of the extrusion. The outside lens or the thin film intermediate lens are be tinted or treated with anti-glare or anti UV or colored filter. A pair of inside bottom grooves holds an inside lens. The inside lens is placed between the concave lens and the LED element, and the concave lens and the inside lens form a middle air gap between them. The inside lens and a bottom inside surface of the extrusion form an inside air gap.

The inside lens can be formed as a laminate of a first inside lens and a second inside lens.

The lamp includes an extrusion that is covered by an outside lens. A number of internal components are included between the extrusion and outside lens. A base end cap receives a wire harness which includes power and potentially a signal wire also. The base end cap connects the wire harness to the circuit board. The base end cap retains a base end of the outside lens and a base end of the extrusion. A top end cap caps the lamp to retain the end of extrusion with the outside lens at an end of the outside lens.

The extrusion has a plurality of nooks, crannies, protrusions and hollow channels. The extrusion forms a circular cross-section with the outside lens. The extrusion is preferably of aluminum, but could also be plastic or stainless steel. The outside lens has a pair of protrusions that are inwardly disposed for engaging with a pair of outside lens grooves.

A plurality of light emitting diodes, are mounted on a plurality of elongated circuit board. Preferably, several such as three LED elements are mounted on each circuit board and each circuit board is connected to the next circuit board in a series such as by wire. The circuit board preferably includes terminals that connect to the next circuit board. The circuit board is elongate in shape.

The concave lens fits in a pair of concave lens grooves disposed at an upper part of the extrusion. The outside lens covers the concave lens forming an outside air gap between the outside lens and the concave lens. The concave lens directs light to a narrower angle which can be half of the angle of the light without the concave lens. Thus, the concave lens can approximately halve the otherwise wider angle of the light emitting diode.

An intermediate lens can be formed as a thin film for adhering to an inside surface of outside lens, or for adhering to an outside surface of concave lens. The outside lens or the thin film intermediate lens can be tinted or treated with anti-glare or anti UV or colored filter for producing colored light.

The light emitting element is mounted on the circuit board. Beneath the circuit board is a flat surface formed on the aluminum extrusion. Beneath the flat surface are long narrow grooves including an outside bottom groove and an inside bottom groove. The outside bottom groove can be disposed in a pair, such as one on the left and one on the right. Similarly, the inside bottom groove can be disposed in a pair such as one on the left and one on the right. The pair of grooves create a number of protrusions for thermal transfer. A hollow channel is formed in the left and right side of the aluminum extrusion and a pair of side grooves are disposed on the left and right side of the aluminum extrusion. The hollow channel extends from an area the level of the circuit board up to above a pair of inside bottom grooves.

The pair of inside bottom grooves option hold an inside lens which can be made as a two layer lens which would have a first inside lens and a second inside lens. The first inside lens and the second inside lens are elongate following the shape of the long extrusion housing. The first inside lens and the second inside lens can be laminated together. The inside lens is placed between the concave lens and the LED element. The concave lens and the inside lens form a middle air gap between them. Similarly, the inside lens and the bottom of the extrusion form an inside air gap.

The following call out list of elements may be helpful for referencing the elements of the drawings.

50 Lamp
51 Base End Cap
52 Top End Cap
53 Wire Harness
61 Concave Lens
62 Concave Lens Filter Layer
63 Intermediate Lens
64 Outside Lens
70 Extrusion
71 Circuit Board
72 First Led Element
73 Second Led Element
74 Outside Bottom Groove
75 Side Groove
76 Outside Lens Groove
77 Inside Bottom Groove
78 Concave Lens Groove
79 Hollow Channel
91 First Inside Lens
92 Second Inside Lens
94 Outside Air Gap
95 Middle Air Gap
96 Inside Air Gap

DETAILED DESCRIPTION OF THE PREFERRED EMBODIMENTS

Figure 1:
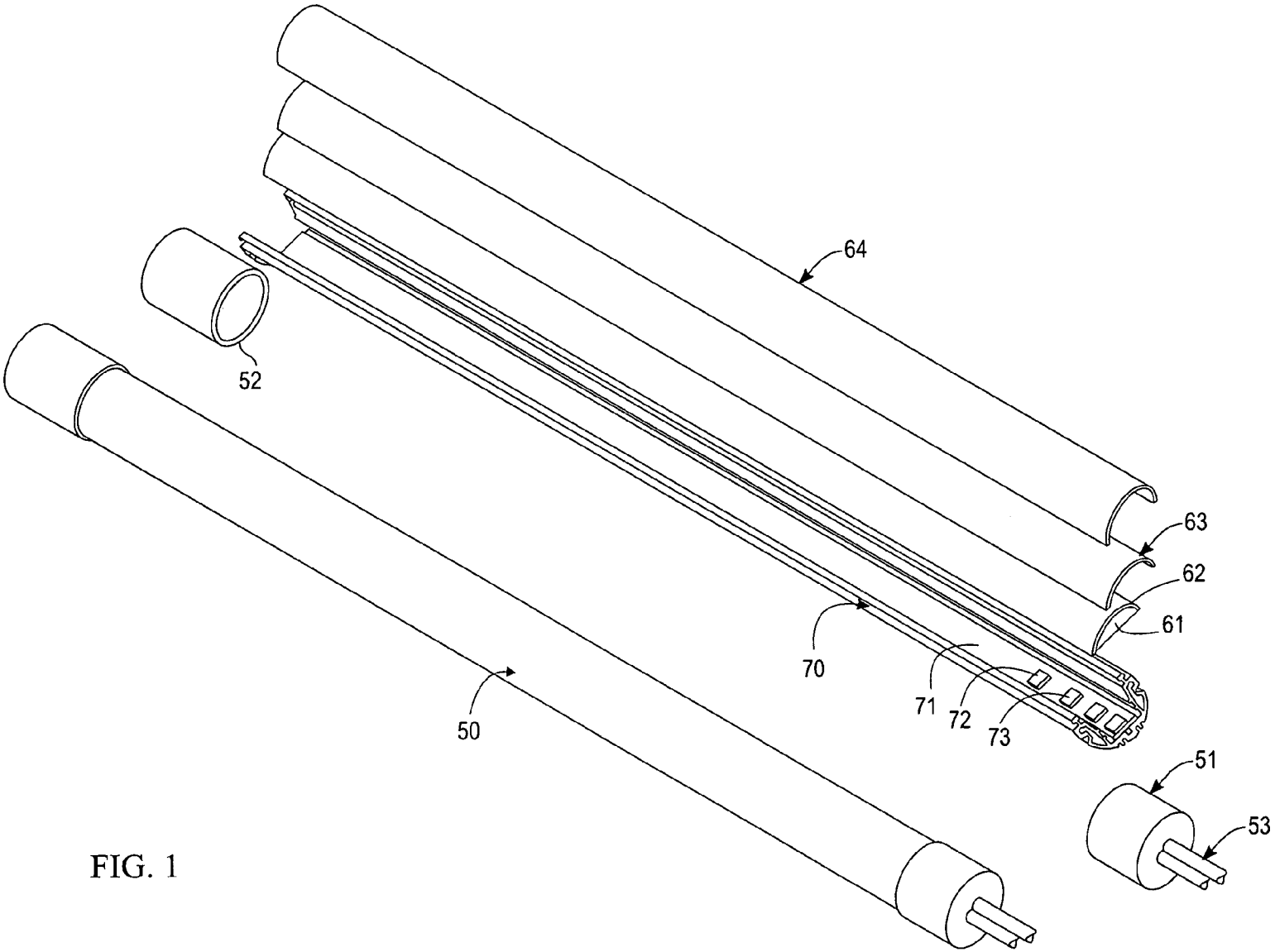
FIG. 1 is a perspective exploded view of the present invention with an assembled view for comparison.

The lamp 50 includes an extrusion 70 that is covered by an outside lens 64, FIG. 1. A number of internal components are included between the extrusion and outside lens. A base end cap 51 receives a wire harness which includes power and potentially a signal wire also. The base end cap 51 connects the wire harness to the circuit board. The base end cap 51 retains a base end of the outside lens 64 and a base end of the extrusion. A top end cap 52 caps the lamp 50 to retain the end of extrusion 70 with the outside lens 64 at an end of the outside lens 64.

Figure 2:
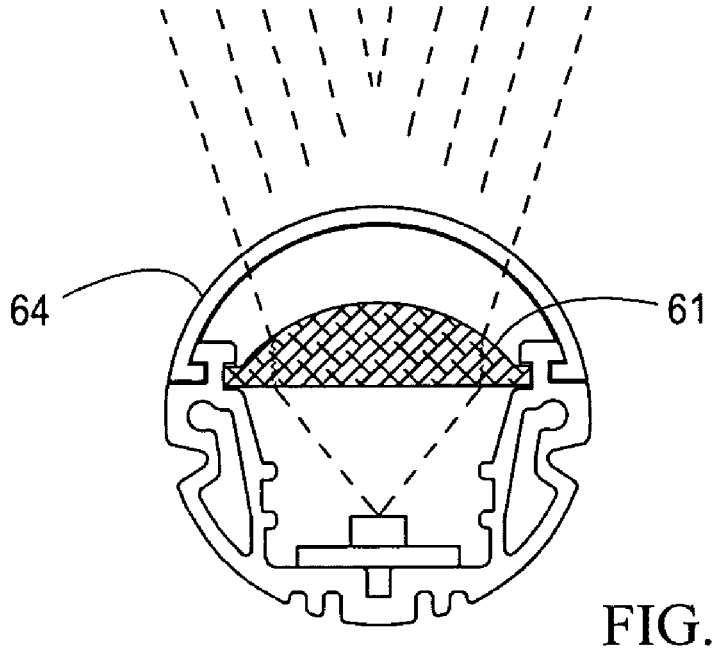
FIG. 2 is a cross-section of the present invention showing the first and second lens.
Figure 3:
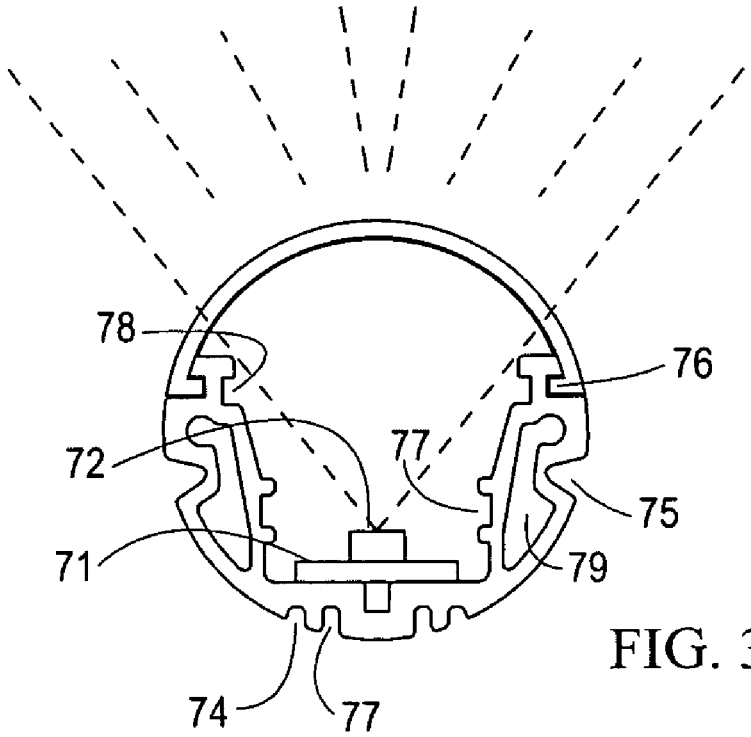
FIG. 3 is a cross-section of the present invention showing the first lens.
Figure 4:
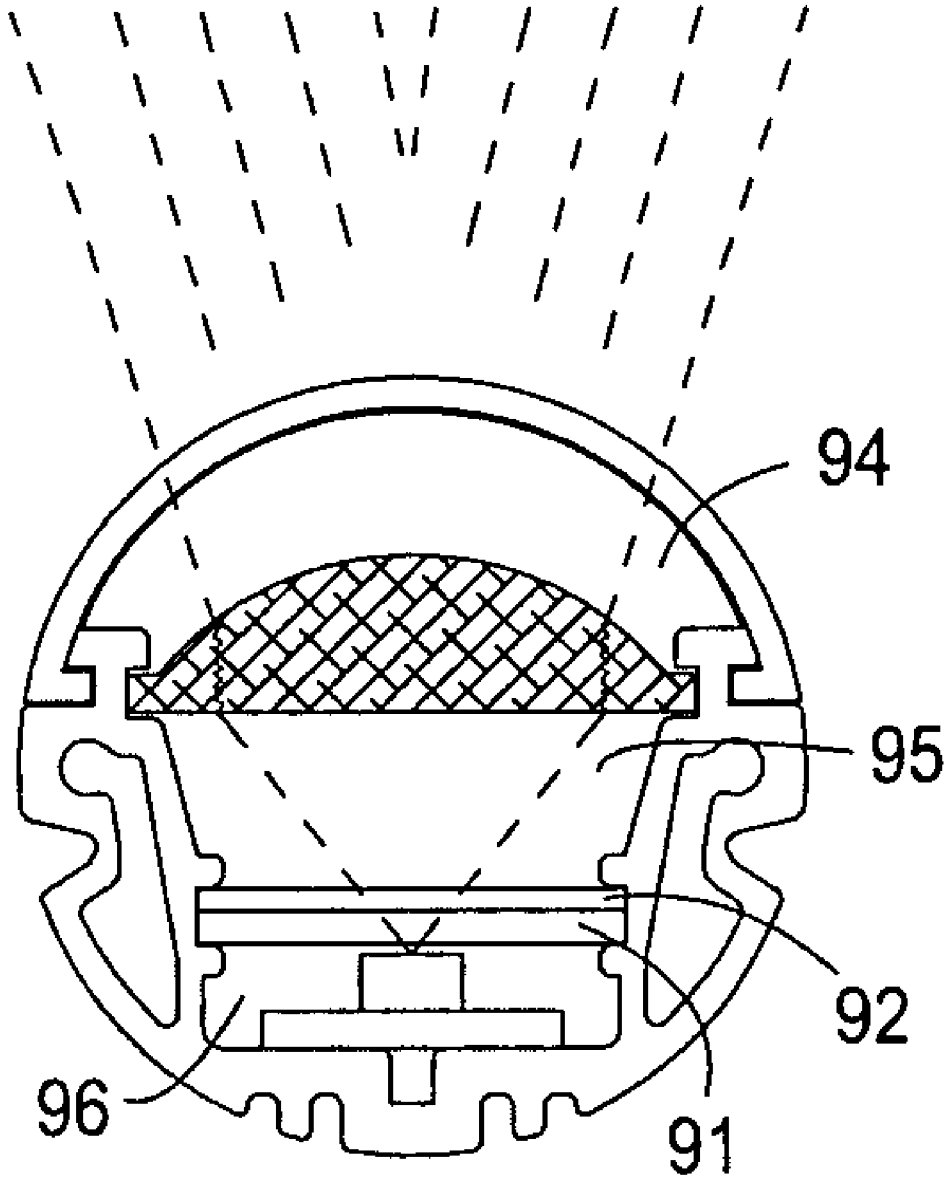
FIG. 4 is a cross-section of the present invention showing the first lens, the second lens, the third lens and the fourth lens.

The extrusion has a plurality of nooks, crannies, protrusions and hollow channels, FIGS. 2, 3, 4. The extrusion forms a circular cross-section with the outside lens 64. The extrusion is preferably of aluminum, but could also be plastic or stainless steel. The outside lens 64 has a pair of protrusions that are inwardly disposed for engaging with a pair of outside lens grooves.

A plurality of light emitting diodes 72, 73 are mounted on a plurality of elongated circuit board 71. Preferably, several such as three LED elements are mounted on each circuit board and each circuit board is connected to the next circuit board in a series such as by wire. The circuit board preferably includes terminals that connect to the next circuit board. The circuit board is elongate in shape.

The concave lens 61 fits in a pair of concave lens grooves 78 disposed at an upper part of the extrusion. The outside lens 64 covers the concave lens 61 forming an outside air gap 94 between the outside lens 64 and the concave lens 61. The concave lens directs light to a narrower angle which can be half of the angle of the light without the concave lens. Thus, the concave lens can approximately halve the otherwise wider angle of the light emitting diode.

An intermediate lens 63 can be formed as a thin film for adhering to an inside surface of outside lens 64, or for adhering to an outside surface of concave lens 61. The outside lens or the thin film intermediate lens can be tinted or treated with anti-glare or anti UV or colored filter for producing colored light.

The light emitting element 72 is mounted on the circuit board 71. Beneath the circuit board 71 is a flat surface formed on the aluminum extrusion. Beneath the flat surface are long narrow grooves including an outside bottom groove 74 and an inside bottom groove 77. The outside bottom groove 74 can be disposed in a pair, such as one on the left and one on the right. Similarly, the inside bottom groove 77 can be disposed in a pair such as one on the left and one on the right. The pair of grooves create a number of protrusions for thermal transfer. A hollow channel 79 is formed in the left and right side of the aluminum extrusion and a pair of side grooves 75 are disposed on the left and right side of the aluminum extrusion. The hollow channel 79 extends from an area the level of the circuit board up to above a pair of inside bottom grooves 77.

The pair of inside bottom grooves 77 option hold an inside lens which can be made as a two layer lens which would have a first inside lens 91 and a second inside lens 92. The first inside lens and the second inside lens are elongate following the shape of the long extrusion housing. The first inside lens and the second inside lens can be laminated together. The inside lens is placed between the concave lens and the LED element. The concave lens 61 and the inside lens form a middle air gap between them. Similarly, the inside lens and the bottom of the extrusion form an inside air gap.

The invention claimed is:

1. An LED lamp comprising:

a. an extrusion which is an elongate extrusion housing;

b. an outside lens;

c. a circuit board of elongated shape and mounted to an inside bottom portion of the elongate extrusion housing;

d. a plurality of light emitting diodes mounted to the circuit board;

e. a concave lens mounted to an upper portion of the elongate extrusion housing, wherein the outside lens covers the concave lens forming an outside air gap between the outside lens and the concave lens; and f. a power wire connecting to the circuit board, wherein the concave lens reduces the angle of light passing through the outside lens.

2. The LED lamp of claim 1, further comprising:

a. a base end cap receiving a wire harness, wherein the wire harness further includes power, wherein the base end cap retains a base end of the outside lens and a base end of the extrusion;

b. a top end cap retaining an end of the extrusion and an end of the outside lens.

3. The LED lamp of claim 1, wherein the extrusion forms a generally circular cross-section with the outside lens.

4. The LED lamp of claim 1, wherein the extrusion is made of extruded aluminum.

5. The LED lamp of claim 1, wherein the outside lens has a pair of protrusions that are inwardly disposed for engaging with a pair of outside lens grooves.

6. The LED lamp of claim 1, wherein the circuit board is made in different parts, each part having a plurality of LED.

7. The LED lamp of claim 1, wherein the concave lens fits in a pair of concave lens grooves disposed at an upper part of the extrusion.

8. The LED lamp of claim 1, further comprising an intermediate lens formed as a thin film for adhering to an inside surface of outside lens, or for adhering to an outside surface of concave lens, wherein the intermediate lens is mounted intermediate the outside lens and the concave lens.

9. The LED lamp of claim 1, further comprising a plurality of longitudinal grooves disposed in an exterior surface of the extrusion.

10. The LED lamp of claim 1, wherein the outside lens or a thin film intermediate lens are be tinted or treated with anti-glare or anti UV or colored filter.

11. The LED lamp of claim 1, further comprising a pair of inside bottom grooves holding an inside lens; wherein the inside lens is placed between the concave lens and the LED element, wherein the concave lens and the inside lens form a middle air gap between them; wherein the inside lens and a bottom inside surface of the extrusion form an inside air gap.

12. The LED lamp of claim 1, wherein an inside lens is formed as a laminate of a first inside lens and a second inside lens.

13. An LED lamp comprising:

a. an extrusion which is an elongate extrusion housing, wherein the extrusion is made of extruded aluminum;

b. an outside lens;

c. a circuit board of elongated shape and mounted to an inside bottom portion of the elongate extrusion housing;

d. a plurality of light emitting diodes mounted to the circuit board;

e. a concave lens mounted to an upper portion of the elongate extrusion housing, wherein the outside lens covers the concave lens forming an outside air gap between the outside lens and the concave lens;

f. a power wire connecting to the circuit board;

g. a base end cap receiving a wire harness, wherein the wire harness further includes power, wherein the base end cap retains a base end of the outside lens and a base end of the extrusion;

h. a top end cap retaining an end of the extrusion and an end of the outside lens; and wherein the concave lens reduces the angle of light passing through the outside lens.

14. The LED lamp of claim 13, wherein the outside lens has a pair of protrusions that are inwardly disposed for engaging with a pair of outside lens grooves, wherein the extrusion forms a generally circular cross-section with the outside lens.

15. The LED lamp of claim 13, wherein the circuit board is made in different parts, each part having a plurality of LED.

16. The LED lamp of claim 13, wherein the concave lens fits in a pair of concave lens grooves disposed at an upper part of the extrusion, further comprising a plurality of longitudinal grooves disposed in an exterior surface of the extrusion.

17. The LED lamp of claim 13, further comprising an intermediate lens formed as a thin film for adhering to an inside surface of outside lens, or for adhering to an outside surface of concave lens, wherein the intermediate lens is mounted intermediate the outside lens and the concave lens.

18. The LED lamp of claim 13, wherein the outside lens or the thin film intermediate lens can be tinted or treated with anti-glare or anti UV or colored filter for producing colored light, wherein an inside lens is formed as a laminate of a first inside lens and a second inside lens.

19. The LED lamp of claim 13, further comprising a pair of inside bottom grooves holding an inside lens; wherein the inside lens is placed between the concave lens and the LED element, wherein the concave lens and the inside lens form a middle air gap between them; wherein the inside lens and a bottom inside surface of the extrusion form an inside air gap.

* * * * *